US005649635A

United States Patent [19]

Casavant et al.

[11] Patent Number: 5,649,635

[45] Date of Patent: Jul. 22, 1997

[54] EASILY REMOVABLE SHEAVE ASSEMBLY

[75] Inventors: Terry S. Casavant, Two Rivers; Paul M. Pukita, Manitowoc; Michael J. Wanek, Two Rivers, all of Wis.

[73] Assignee: Manitowac Crane Group, Inc., Reno, Nev.

[21] Appl. No.: 241,681

[22] Filed: May 12, 1994

Related U.S. Application Data

[63] Continuation of Ser. No. 762,766, Sep. 20, 1991, abandoned.

[51] Int. Cl.[6] ..... B66C 23/70; B66C 23/06; B66D 3/06

[52] U.S. Cl. ..... 212/177; 212/175; 212/231; 212/255; 212/347; 254/402; 254/403; 254/404

[58] Field of Search ..... 212/309–312, 212/317, 223, 227, 231, 255, 347, 175, 177; 264/390, 392, 401–405

[56] References Cited

U.S. PATENT DOCUMENTS

| | | | |
|---|---|---|---|
| 1,668,497 | 5/1928 | Fishback . | |
| 1,771,059 | 7/1930 | Regan | 254/404 |
| 1,797,406 | 3/1931 | Erlewine | 254/393 |
| 1,824,652 | 9/1931 | Boykin, Jr. | 254/393 |
| 1,836,281 | 12/1931 | Russell . | |
| 1,898,810 | 2/1933 | Bergmann | 256/403 |
| 2,007,155 | 7/1935 | Burn et al. | 254/393 |
| 2,079,725 | 5/1937 | Wickersham et al. . | |
| 2,084,718 | 6/1937 | Zeilman | 212/347 |
| 2,180,541 | 11/1939 | Nichols | 254/404 |
| 2,282,633 | 5/1942 | Young | 254/404 |
| 2,292,457 | 8/1942 | Mair | 254/404 |
| 2,368,333 | 1/1945 | Taylor et al. | 212/266 |
| 2,459,290 | 1/1949 | Rozner . | |
| 2,556,948 | 6/1951 | Sommarstrom | 254/393 |
| 2,672,320 | 3/1954 | Minor | 254/404 |
| 2,717,184 | 9/1955 | Amerman | 254/404 |
| 2,960,310 | 11/1960 | Hull . | |
| 3,680,840 | 8/1972 | Pech | 212/266 |
| 3,757,959 | 9/1973 | Thompson et al. | 212/266 |
| 3,786,935 | 1/1974 | Vlazny et al. . | |
| 4,676,484 | 6/1987 | Reed | 254/402 |

FOREIGN PATENT DOCUMENTS

| | | | |
|---|---|---|---|
| 2186419 | 1/1974 | France . | |
| 2450228 | 9/1980 | France . | |
| 3042287 | 6/1982 | Germany | 212/177 |
| 405234 | 7/1943 | Italy | 254/393 |

OTHER PUBLICATIONS

European Search Report and Annex thereto listing and commenting on the above–listed references (date: Jan. 4, 1993).

DEMAG Advertising Brochure.

*Primary Examiner*—Karen B. Merritt

*Assistant Examiner*—R. B. Johnson

*Attorney, Agent, or Firm*—Steven P. Shurtz; Brinks Hofer Gilson & Lione

[57] ABSTRACT

A crane boom top is disclosed in which a sheave assembly having a number of sheave sets is supported on the crane boom top by boom sheave supports. Each sheave set is mounted on an individual shaft and connectors connect the individual shafts to the boom sheave supports.

14 Claims, 5 Drawing Sheets

EASILY REMOVABLE SHEAVE ASSEMBLY

This application is a continuation of application Ser. No. 07/762/766, filed Sep. 20, 1991, now abandoned.

BACKGROUND OF THE INVENTION

The present invention relates to crane sheave assemblies used for load lifting. The purpose of the present invention is to address sheave assembly removal problems found in the current art.

Currently, cranes are designed having a number of possible boom tops. Specific boom tops are used depending on the type of lift required. Typically, there are boom top designs for normal liftcrane work, for heavier loads and for lighter loads that must be lifted from a greater distance.

All crane boom tops have sheave assemblies, over which the lift rope is carried. The currently available crane sheave assemblies consist of sheaves mounted on continuous through-shafts. Typically, sheave assemblies differ only by the number of sheaves contained therein. The heavier the load required to be lifted by the crane, the greater the number of sheaves required in the sheave assembly. Since sheave assemblies are self-contained units, crane operators must purchase that sheave assembly with the minimum number of sheaves required to perform the lift.

A limited number of sheave assembly designs are available from which crane operators may choose. Therefore, often, the sheave assembly will contain more sheaves than is necessary to perform a particular lift. These extra sheaves constitute unnecessary weight on the crane boom top which, in turn, necessitate additional crane counterweight in order to maintain crane stability. Keeping the crane boom top as light as possible maximizes the boom length that can be used and load that can be raised, and minimizes the crane counterweight required. Usually, however, because of the current difficulty in removing individual sheaves from sheave assemblies, unnecessary sheaves are not removed and the crane operator instead operates the crane with a shorter boom or increased crane counterweight. Thus, it would be advantageous to design a sheave assembly from which unnecessary sheaves could be easily removed.

Similarly, if individual sheaves in the sheave assemblies require repair or replacement, the entire through-shaft must be detached from the crane boom top and successive sheaves removed from the shaft until the target sheave is reached. This inevitably results in the need for the sheaves to be repositioned and realigned on the through-shaft. Oftentimes, this procedure causes sheave bearings to be damaged.

SUMMARY OF THE INVENTION

The present invention contemplates a crane sheave assembly having any number of sheave sets individually mounted to removable shafts. Boom sheave supports extend into the sheave assembly from the crane boom top. Each removable shaft fits between, and is supported by, two boom sheave supports.

In the preferred embodiment, the removable shafts are supported by open collars welded to the boom sheave supports. The open collars permit the shafts to be withdrawn from between their respective boom sheave supports and support the load imposed by the sheave rope on the sheaves. Since the shafts are entirely independent of one another, they can be removed from the sheave assembly without removing other shafts.

The present invention has a distinct advantage over the current art in that it allows individual sheave sets to be easily removed from, or added to, a crane sheave assembly according to the lifting needs of the crane operator. Thus, the crane operator is able to "construct" his own sheave assembly. Unnecessary sheaves can be easily removed from the sheave assembly in order to reduce boom top weight, increase boom length, reduce crane counterweight or any combination thereof. Furthermore, if individual sheaves require repair or replacement, only the sheave set containing that sheave need be removed from the sheave assembly. This eliminates removal of the entire sheave assembly, thereby preventing the misalignment of all the sheaves in the sheave assembly and the need for subsequent realignment. Also, the division of the sheave assembly into sheave sets reduces the weight that must be handled when making adjustments to the sheave assembly; instead of having to manipulate the weight of an entire sheave assembly every time an adjustment is required, one need only to handle the weight of a single sheave set.

The preferred embodiment of the invention includes features in addition to those listed above. Also, the advantages over the current art outlined above are directly applicable to the preferred embodiment, but are not exclusive. The present invention is illustrated by reference to a detailed description of the preferred embodiment.

DETAILED DESCRIPTION OF THE PRESENTLY PREFERRED EMBODIMENTS

The preferred embodiment of the present invention relates to a self-assembling crane, other aspects of which are disclosed in the following copending applications assigned to the assignee of the present application, being filed concurrently herewith unless otherwise specified:

"Self-Assembling and Self-Disassembling Crawler Crane", filed Sep. 20, 1991 (Ser. No. 07/762/767), abandoned in favor of Ser. No. 08/170/682, now U.S. Pat. No. 5,484,069;

"Multi-Coupling Device for Crane Hydraulic Lines", filed Sep. 20, 1991 (Ser. No. 07/762,771) and issued Sep. 22, 1992 as U.S. Pat. No. 5,148,929;

"Quick-Connect Sectional Boom Members for Cranes and the Like", filed Jul. 25, 1991 (Ser. No. 07/736,029) and issued Apr. 6, 1993 as U.S. Pat. No. 5,199,586;

"Crane Upper Works to Lower Works Alignment System", filed Sep. 20, 1991 (Ser. No. 07/762/765) and issued as U.S. Pat. No. 5,427,256;

"Carbody to Crawler Connection", filed Sep. 20, 1991 (Ser. No. 07/762,764);

"Control and Hydraulic System for a Liftcrane", filed Oct. 10, 1989 (Ser. No. 07/418,879) and issued Feb. 23, 1993 as U.S. Pat. No. 5,189,605; and "Control and Hydraulic System for Liftcrane", filed Aug. 13, 1990 (Ser. No. 07/566,751), a continuation-in-part application of application Ser. No. 07/418,879, now U.S. Pat. No. 5,189,606.

The crane of the preferred embodiment also uses the swing lock mechanism disclosed in application Ser. No. 07/556,840, filed Jul. 23, 1990, now U.S. Pat. No. 5,176,267. Each of these applications is hereby incorporated by reference.

Figure 1:
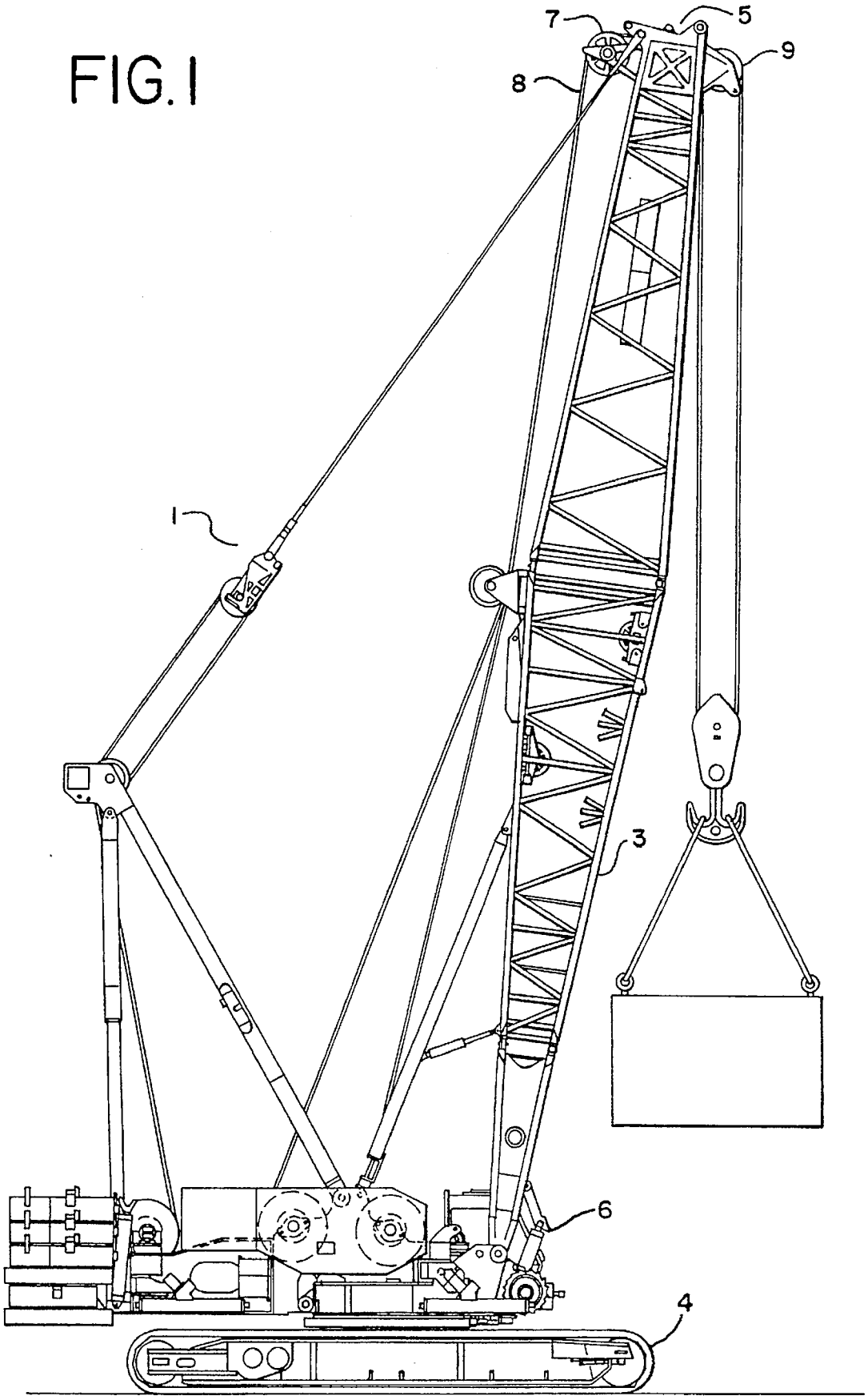
FIG. 1 is an elevational view of a crane having a hammerhead design boom top made in accordance with the present invention.

The apparatus of FIG. 1 comprises a crane 1 having a crane lowerworks 4, a crane upperworks mounted on the crane lowerworks for pivotal movement about a vertical swing axis, and a boom 3 mounted on the crane upperworks 6, the boom 3 having a boom top 5. The crane boom top 5 is of the hammerhead (or heavy lift) design, having a rope guide sheave 7 and a load-bearing sheave assembly 9. The rope guide sheave 7 guides the liftrope 8 to the sheave assembly 9. While the crane boom top 5 depicted is of the hammerhead design, the present invention is applicable to all other crane boom top designs.

Figure 2:
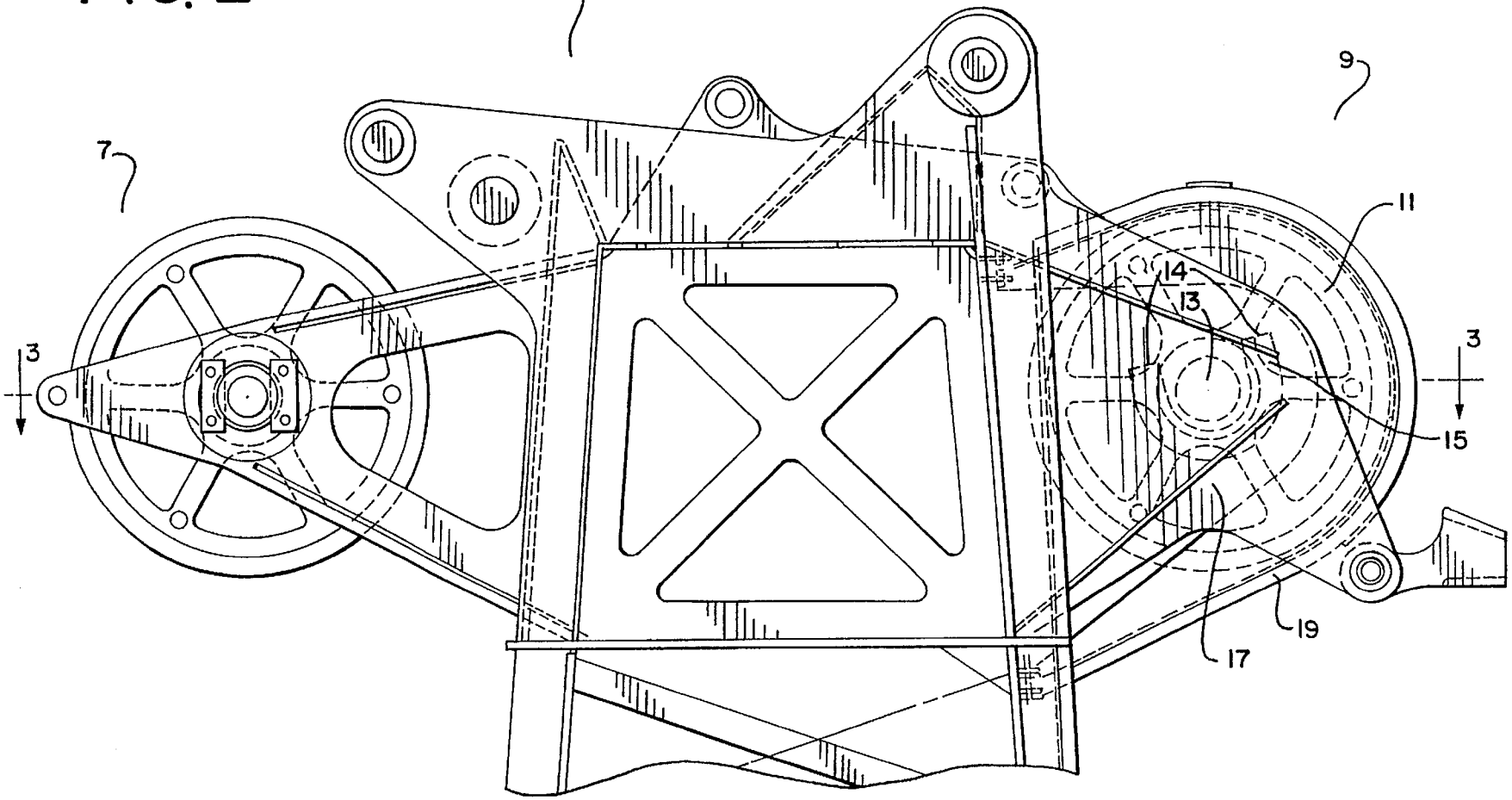
FIG. 2 is an enlarged plan view of the boom top of FIG. 1.
Figure 3:
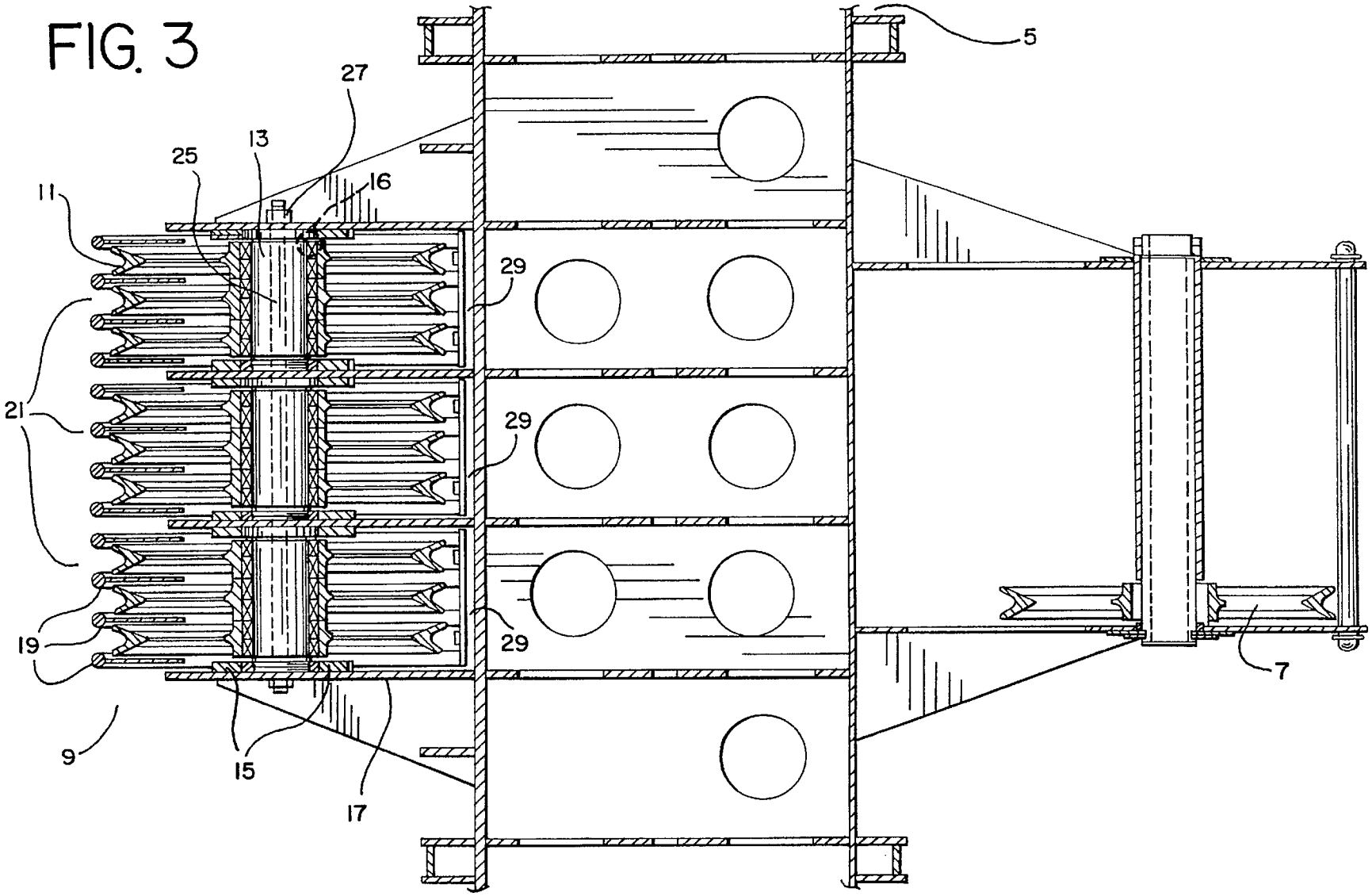
FIG. 3 is a cross-section taken along line 3—3 of FIG. 2.

As shown in FIGS. 2 & 3, the crane boom top 5 includes a rope guide sheave 7 and a sheave assembly 9. In the sheave assembly 9, sheaves 11 are rotatably mounted on hollow shafts 13. Open collars 15 having openings 14 are welded onto boom sheave supports 17 and the ends of hollow shafts 13 rest within the saddle of open collars 15. Sheave rope guard 19 encircles sheave assembly 9 in order to prevent a sheave rope from jumping sheaves within the sheave assembly.

The preferred embodiment of sheave assembly 9, as depicted in FIG. 3, comprises three sheave sets 21 having three sheaves 11 apiece. Each sheave set 21 is rotatably mounted on a removable hollow shaft 13. Boom sheave supports 17 extend from the crane boom top 5 into sheave assembly 9 such that sheave sets 21 are distinctly identifiable. Open collars 15 are welded onto boom sheave supports 17 and the ends of hollow shafts 13 rest within open collars 15. A bolt 25 inserted through the shafts 13 and the holes in the boom sheave supports 17, and a hexagonal nut 27 turned on the threaded end of the bolt 25, function as a connector and ties the sheave assembly 9 together and prevents slack between the shafts 13 and the boom sheave supports 17 in the sheave assembly 9. Sheave rope guard assemblies 29 are positioned between adjacent boom sheave supports 17 and are bolted to crane boom top 5. Thus, each sheave set 21 has its own sheave rope guard assembly 29. Each sheave rope guard assembly 29 contains four sheave rope guards 19 extending between and beyond the sheaves 11 in the respective sheave set 21.

Figure 4:
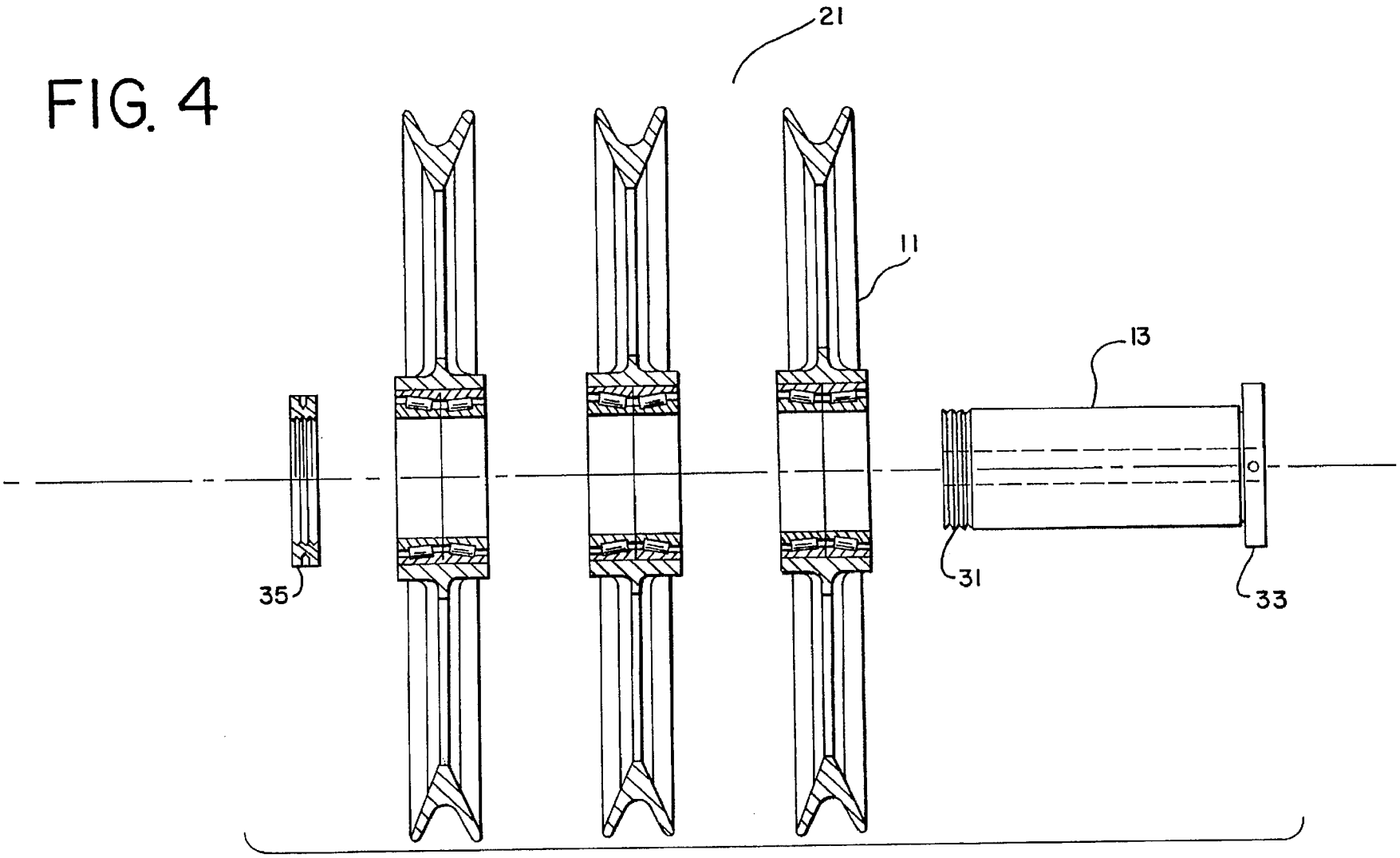
FIG. 4 is an exploded view of a sheave set of FIG. 3.

FIG. 4 provides an exploded view of a sheave set 21. Three sheaves 11 are mounted along hollow shaft 13. Hollow shaft 13 has a threaded end 31 and a flanged end 33. A shaft nut 35 turned on the threaded end 31 of the hollow shaft 13 functions as a seconded flanged end 33 and, in conjunction with the flanged end 33 of the hollow shaft 13, hold the sheaves 11 of the sheave set 21 in position along the shaft 13.

Figure 5:
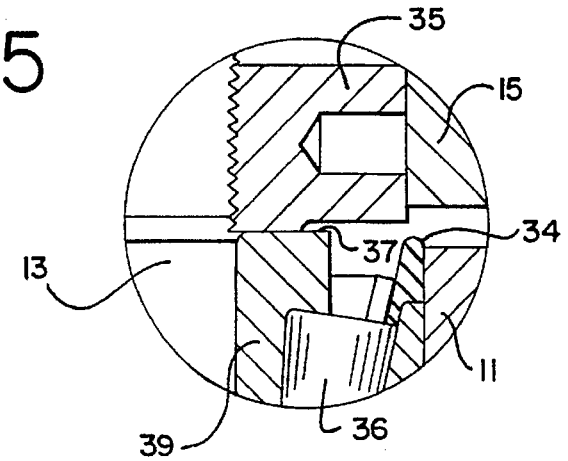
FIG. 5 is an enlarged cross-sectional view of the shaft nut engaging a sheave on a removable shaft section of FIG. 3.

FIG. 5 shows an enlarged view of the area 16 in FIG. 3 and the cooperation between a hollow shaft 13, a sheave 11 and a shaft nut 35 when a sheave set 21 (not shown) is assembled. The shaft nut 35 is turned on the hollow shaft 13 and tightened against a sheave 11. The tightening of the shaft nut 35 serves to pre-load the sheave bearings 36. A relief 37 is formed on the shaft nut 35 to ensure that it wears only on the bottom race 39 of the sheave bearing 36, and to provide clearance between the sheave 11, the shaft nut 35, the bearing seal 34 and the open collar 15. A relief (not shown) is also formed on the flanged end 33 of hollow shaft 13 for the same reasons.

Figure 6:
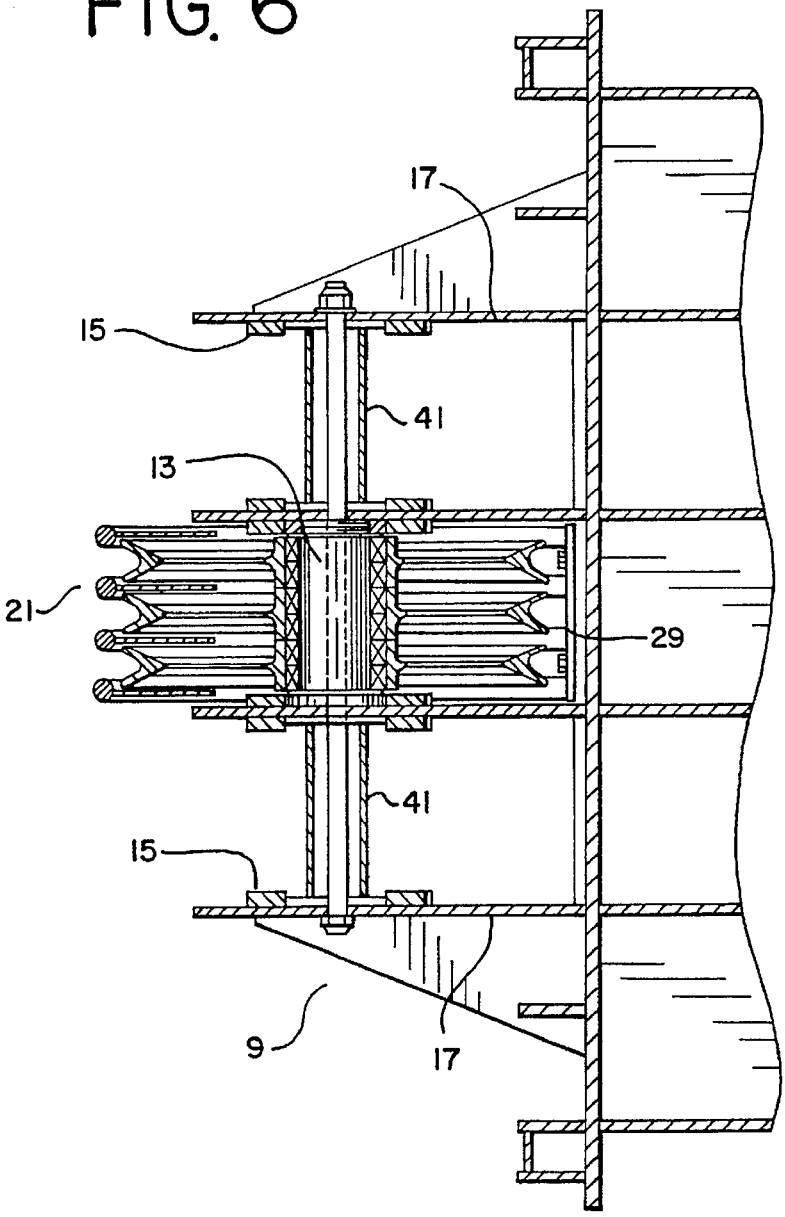
FIG. 6 is a cross-section as in FIG. 3, with two of the sheave sets removed.

FIG. 6 illustrates the cross-section of the sheave assembly 9 when two sheave sets 21, and their respective sheave rope guard assemblies 29, are removed therefrom. Hollow spacers 41 replace the shafts 13 removed from the sheave assembly 9, the spacers 41 resting within the open collars 15 welded to the boom sheave supports 17.

In the preferred embodiment, the presence of bolt 25 requires that the sheave sets 21 be aligned along the bolt 25 axis and that the bolt 25 be removed before individual shafts 13 can be removed from the sheave assembly 9. Any shafts 13 removed from the sheave assembly 9 are replaced by dimensionally identical spacers 41, as shown in FIG. 6, to insure that the sheave assembly 9 remains "tight".

The purposes for the open collars 15 shown in FIGS. 2 & 3 are shaft support and load bearing. The load imposed on the sheaves 11 by a sheave rope is transferred to the open collars 15 via the shafts 13. Furthermore, the openings of the open collars 15 preferably face substantially away from the ground surface when the crane boom top 5 is in an operational position, such that the open collars 15 bear the load imposed upon the sheave sets 21 at a position nearly opposite the openings of the collars 15.

The individual sheave rope guard assemblies 29 provided for each sheave set 21 eliminates the need to detach the sheave rope guards 19 for the entire sheave assembly 9 in order to remove, or gain access to, only one sheave set 21.

In addition, a thread bonding adhesive (not shown) is placed upon shaft nut 35 to prevent the shaft nut 35 from loosening and, thereby, removing the pre-loading on the sheave bearings 36.

Another embodiment of the present invention is contemplated wherein the sheave sets 21 are not aligned along a common bolt 25. Instead, each sheave set has its own bolt 25 inserted through its shaft 13 and boom sheave supports 17. In this embodiment, no sheave set 21 would share a common boom sheave support 17 with another sheave set 21.

In yet another embodiment of the present invention, although impractical from an operational standpoint, the sheave sets 21 are staggered such that they do not all lie along the same axis in space.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

We claim:

1. A crane comprising:

a) a crane lowerworks;

b) a crane upperworks mounted on said lowerworks for pivotal movement about a vertical swing axis; and c) a boom mounted on the upperworks having a boom top, the boom top comprising:

i) a plurality of boom sheave supports, each having a hole therethrough, the holes lying on a common line;

ii) a plurality of hollow shafts each disposed between a pair of the boom sheave supports, at least one of the hollow shafts having a plurality of sheaves rotatably mounted thereon and having two flanged ends configured to hold the sheaves in place along the shaft;

iii) a plurality of the boom sheave supports having at least one open collar mounted thereon to receive and support the flanged ends; and iv) a connector disposed through the hollow shafts and the holes in the boom sheave supports.

2. The crane of claim 1 wherein at least one of the hollow shafts has no sheaves rotatably mounted thereon and constitutes a spacer.

3. The crane of claim 2 wherein the at least one spacer is dimensionally identical to the hollow shaft which has a plurality of sheaves rotatably mounted thereon.

4. The crane of claim 1 wherein the plurality of sheaves comprises three sheaves.

5. The crane of claim 1 wherein the boom top comprises a plurality of sheave sets, each sheave set comprising said hollow shaft and having a plurality of sheaves rotatably mounted thereon.

6. The crane of claim 5 wherein each sheave set comprises three sheaves.

7. The crane of claim 1 wherein one of the two flanged ends comprises a threaded end with a shaft nut turned thereon.

8. The crane of claim 1 wherein the connector comprises a bolt having a threaded end and a fastener turned on the threaded end of the bolt.

9. The crane of claim 1 wherein the opening in the open collars face substantially away from the ground surface when the crane boom top is in an operational position, such that the open collars bear a load imposed upon the shafts supported by the collars at a position nearly opposite the open portion of the collar.

10. The crane of claim 1 wherein the boom top further comprises a sheave rope guard assembly having a plurality of sheave rope guards extending beyond the outer diameters of the sheaves and positioned between the sheaves such that a rope on the sheaves will not jump sheaves.

11. The crane of claim 10 wherein a sheave rope guard assembly is between each adjacent pair of boom sheave supports that support a shaft having one or more sheaves rotateably mounted thereon.

12. The crane of claim 1 wherein one or more of the hollow shafts can be removed from the boom top without disturbing either the alignment or positioning of sheaves on that shaft or of sheaves on other shafts remaining in the boom top.

13. The crane of claim of claim 1 wherein the boom top comprises at least three boom sheave supports.

14. The crane of claim 1 wherein a) said plurality of boom sheave supports comprises at least three boom sheave supports, each with at least one open collar thereon;

b) each adjacent pair of boom sheave supports has a hollow shaft disposed therebetween;

c) each hollow shaft has a plurality of sheaves rotateably mounted thereon and one flanged end and one threaded end with a shaft nut turned thereon, the flanged end and shaft nut cooperating to hold the sheaves in place along the shaft and being supported in one of said open collars; and d) the connector comprises a bolt having a threaded end and a fastener turned on the threaded end of the bolt.

* * * * *

UNITED STATES PATENT AND TRADEMARK OFFICE

CERTIFICATE OF CORRECTION

PATENT NO. : 5,649,635
DATED : July 22, 1997
INVENTOR(S) : Terry S. Casavant et al.

It is certified that error appears in the above-indentified patent and that said Letters Patent is hereby corrected as shown below:

On the Title Page

In column 1, Item [73], change "Manitowac" to --Manitowoc--.

In column 2, line 2, change "Mair" to --Maier--.

In the Claims

In claim 13, line 1, delete "of claim" (first occurrence).

Signed and Sealed this

Fourteenth Day of March, 2000

*Attest:*

*Attesting Officer*

Q. TODD DICKINSON

*Commissioner of Patents and Trademarks*